US006536398B2

(12) United States Patent
Neal

(10) Patent No.: US 6,536,398 B2
(45) Date of Patent: Mar. 25, 2003

(54) FLUID FLOW INSERT FOR FRONT COVER OF ENGINE

(75) Inventor: Timothy L. Neal, Ortonville, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/938,219

(22) Filed: Aug. 24, 2001

(65) Prior Publication Data

US 2003/0037754 A1 Feb. 27, 2003

(51) Int. Cl.[7] ..... F02F 7/00
(52) U.S. Cl. ..... 123/195 C
(58) Field of Search ..... 123/195 C

(56) References Cited

U.S. PATENT DOCUMENTS 5,477,817 A 12/1995 Hufendiek et al. ..... 123/41.33
5,704,329 A 1/1998 Bublitz et al. ..... 123/195 A
6,247,436 B1 6/2001 Lancefield et al. ..... 123/90.38

*Primary Examiner*—Tony M. Argenbright
*Assistant Examiner*—Katrina B. Harris
(74) *Attorney, Agent, or Firm*—Leslie C. Hodges

(57) ABSTRACT

An engine assembly for a vehicle includes an engine crankshaft protruding from a front end of a cylinder block of the engine. A front cover is secured to the front end of the engine. A pump is positioned within the front cover and operatively connected with said engine crankshaft. A fluid passage is formed by the front cover for receiving pumped fluid from the pump and directing the fluid into the cylinder block. The fluid passage has an exit port with a curved portion of the passage positioned closely adjacent the exit port. A plastic insert is positioned within the curved portion and within the exit port. The plastic insert has a plurality of curved fluid flow vanes to direct flowing fluid through the curved portion in a manner to improve laminarity of flow in the curved portion and in the exit port to reduce fluid flow losses.

7 Claims, 2 Drawing Sheets

FLUID FLOW INSERT FOR FRONT COVER OF ENGINE

TECHNICAL FIELD

The present invention relates to a fluid flow insert for directing flowing fluid from a curved passage in a front engine cover toward a cylinder block of the engine.

BACKGROUND OF THE INVENTION

A front cover is typically mounted on the front end of an internal combustion engine, and may include various engine accessories mounted thereon, such as an oil pump, an air compressor, a heat exchanger, an oil filter, a coolant pump, a thermostat, etc. Various configurations of front covers are shown, for example, in U.S. Pat. Nos. 6,247,436, 5,704,329 and 5,477,817.

In those front covers which incorporate an oil pump or coolant pump, fluid flow channels are formed within the front cover to carry the pumped fluid to the adjacent cylinder block. In the interest of improved packaging, overall engine size has continuously decreased. Accordingly, the size of the front cover has decreased. Specifically, the cover has gotten thinner. In transverse-mounted engines, the cover has gotten approximately 50% thinner. This is potentially problematic because a pump, such as a coolant pump, in a front cover would pump the coolant along a front cover fluid flow channel which is transverse to the engine block. This flowing fluid must then be redirected orthogonally toward the engine block to cool the engine block. In such a thin front cover, the orthogonal turn in the fluid flow channel must be very sharp, which may induce turbulence, and therefore loss of efficiency in the cooling system.

Accordingly, there is a need to improve the efficiency of pumped fluid traveling from a front cover to an engine cylinder block.

SUMMARY OF THE INVENTION

The present invention provides a plastic insert which is positioned within the curved portion of a front cover fluid passage to improve flow conditions. The plastic insert includes a plurality of curved fluid flow vanes to direct flowing fluid through the curved portion in a manner to improve laminarity of the flow and to reduce fluid losses.

More specifically, the invention provides an engine assembly for a vehicle, including an engine crankshaft protruding from a front end of a cylinder block of the engine and a front cover secured to the front end of the engine. A pump is positioned within the front cover and operatively connected with the engine crankshaft. A fluid passage is formed by the front cover for receiving pumped fluid from the pump and directing the fluid into the cylinder block. The fluid passage has an exit port with a curved portion of the passage positioned closely adjacent the exit port. A plastic insert is positioned within the curved portion and within the exit port. The plastic insert has a plurality of curved fluid flow vanes to direct flowing fluid through the curved portion in a manner to improve laminarity of flow in the curved portion and in the exit port to reduce fluid flow losses.

Preferably, the plastic insert includes a rim which is trapped between the exit port and the cylinder block of the engine. The plastic insert is preferably injection molded from a plastic material having high heat characteristics, and the front cover is preferably a cast aluminum component which is bolted to the cylinder block.

Another aspect of the invention provides a method of manufacturing a vehicle engine assembly including the steps of:

a) providing a crankshaft protruding from a front end of an engine;

b) providing a front cover over the front end of the engine, the front cover including a pump therein operatively driven by the crankshaft for pumping fluid through a fluid passage formed within the front cover, the fluid passage having an exit port facing a cylinder block of the engine and having a curved portion of the passage closely adjacent the exit port; and c) trapping a rim of a plastic insert between the cylinder block and the exit port, the plastic insert having a plurality of curved fluid flow vanes positioned in the curved portion of the fluid passage to direct flowing fluid through the curved portion in a manner to improve laminarity of flow in the curved portion and in the exit port to reduce fluid flow losses.

Accordingly, an object of the invention is to provide an improved front cover assembly in which fluid flow losses are reduced for fluids being directed into an adjacent cylinder block.

The above object and other objects, features, and advantages of the present invention are readily apparent from the following detailed description of the best mode for carrying out the invention when taken in connection with the accompanying drawings.

DESCRIPTION OF THE PREFERRED EMBODIMENT

Figure 1:
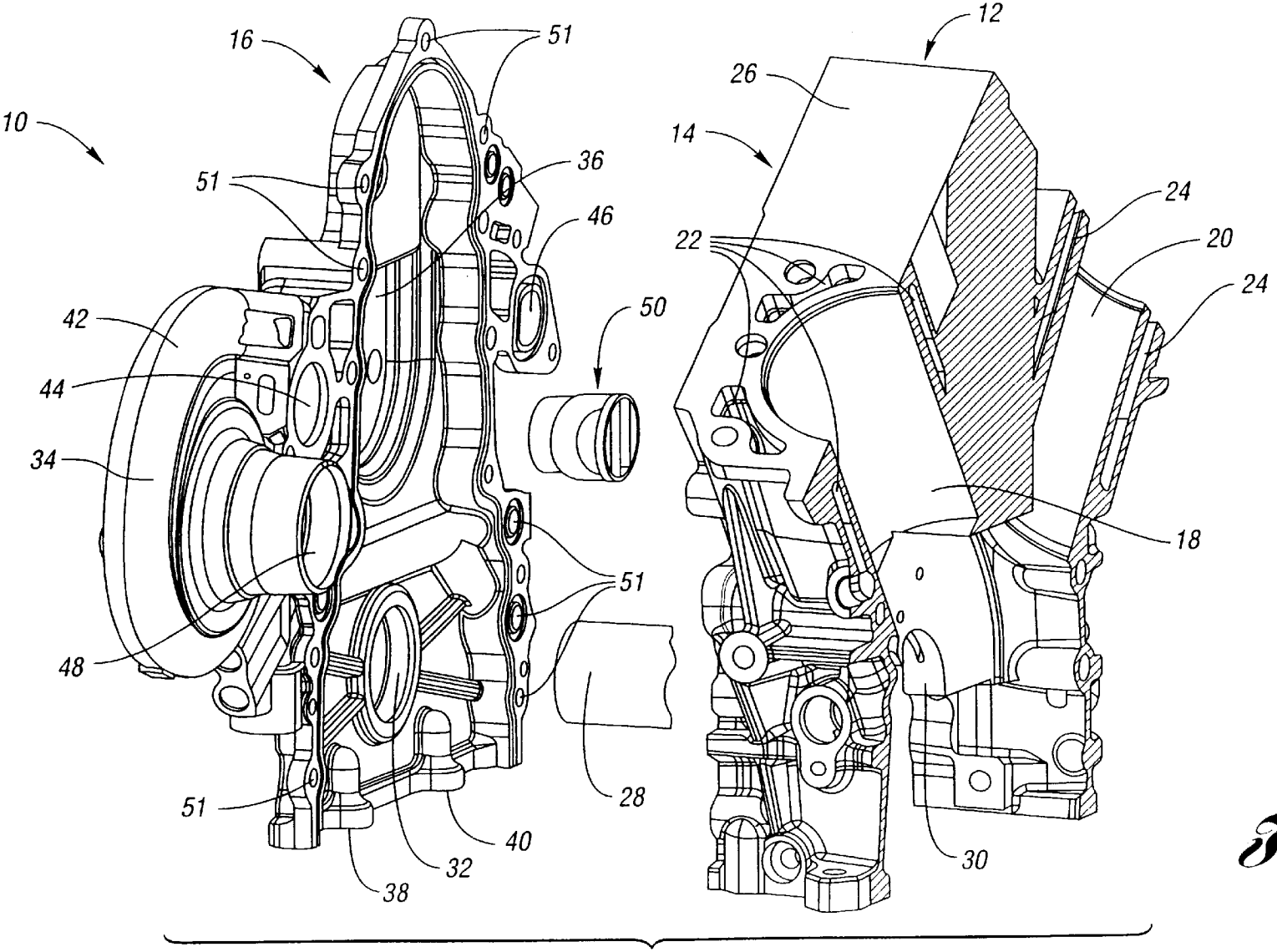
FIG. 1 shows a partially cut-away exploded perspective view of an engine assembly in accordance with the present invention.

Referring to FIG. 1, an exploded, partially cut-away perspective view is shown of an engine assembly 10 in accordance with the invention. The engine assembly 10 includes a cylinder block 12 which forms a front end 14 of the engine. The front end 14 is covered by a front cover 16.

The cylinder block 12 of the engine assembly 10 includes first and second cylinders 18,20 which are cooled by coolant, such as water, which flows through water passages 22,24, which form a so-called "water jacket" around the cylinders 18,20 to carry heat away from the cylinders 18,20. A cylinder head (not shown) is attached to the top surface 26 of the cylinder block 12.

The front cover 16 includes a pocket 36 which receives the cam drive chain. Attachment features 38,40 of the front cover 16 receive bolts for attaching an oil pan to the engine assembly.

A crankshaft 28 of the engine extends through the aperture 30 of the cylinder block 12 into the aperture 32 of the front cover 16. A pump 34 is integrated into the front cover 16. The pump 34 is operatively connected with the crankshaft 28, such as through a drive belt (not shown), for rotating the pump 34.

When rotated by the crankshaft 28, the pump 34 pumps fluid, such as coolant, through a fluid passage 42, which extends through the front cover 16. Fluid is directed from the fluid passage 42 to exit ports 44,46 for communication with the cylinder block 12. When exiting the exit ports 44,46, the coolant fluid enters corresponding openings in the cylinder block 12, which are in fluid communication with the coolant passages 22,24 for cooling the cylinders 18,20.

As shown in FIG. 1, the exit ports 44 may be round (port 44), "D"-shaped (port 46), or any other desired shape.

Accordingly, water is received in the front cover 16 through the water inlet 48, travels through the fluid passage 42, through various other channels formed integrally within the front cover 16, and finally exits the front cover 16 through the exit ports 44,46. Because the front cover 16 is thin in cross-section, the coolant must travel through a sharply curved portion of the flow passages of the front cover 16 closely adjacent the exit ports 44,46. Because of the sharpness of this curved portion, flow turbulence may arise. Accordingly, a plastic insert 50 is inserted into the exit port 44 to improve laminarity of flow in the curved portion of the fluid passage adjacent the exit port to reduce fluid flow losses. A similar insert may be provided in exit port 46.

The front cover 16 also includes multiple attachment points 51 for bolting to the cylinder block 12. Preferably, the front cover 16 is a cast aluminum component.

Figure 2:
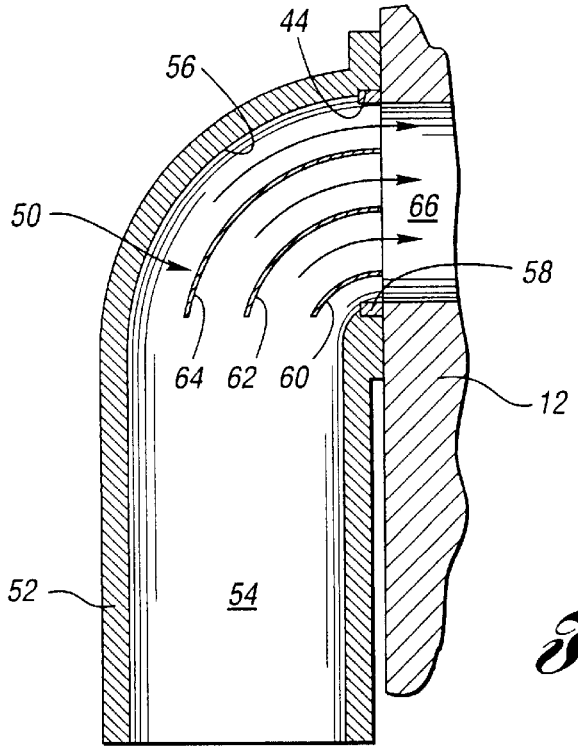
FIG. 2 shows a schematic cross-sectional view illustrating a fluid flow passage and insert in accordance with the invention.
Figure 3:
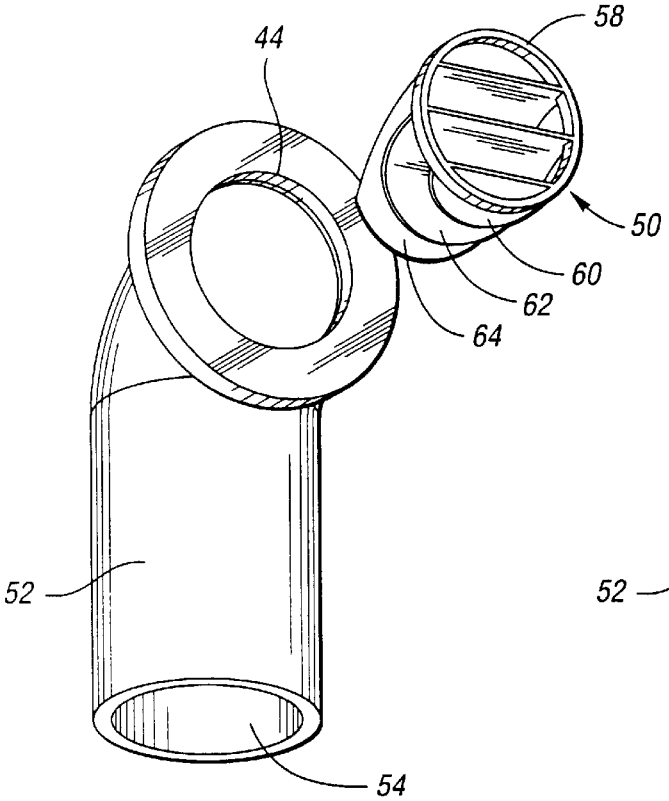
FIG. 3 shows a schematic exploded perspective view of a plastic insert adjacent a coolant flow channel in accordance with the invention.
Figure 4:
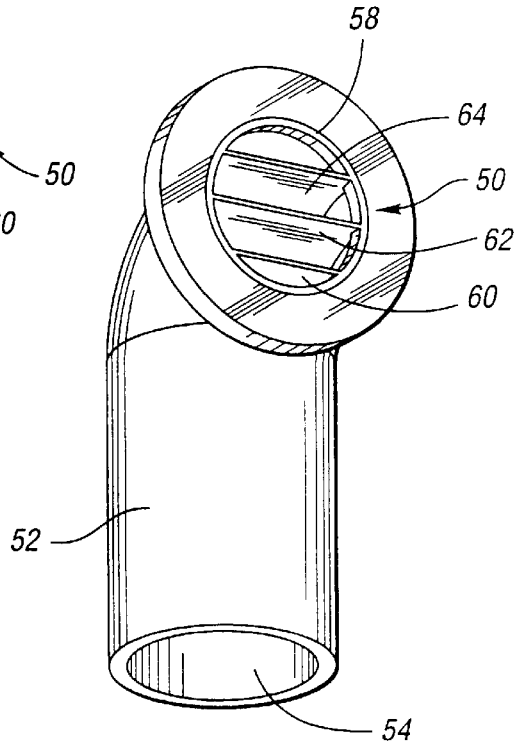
FIG. 4 shows a schematic, perspective assembled view of the structure of FIG. 3.

The invention is shown schematically in FIGS. 2–4, in which a tube 52 is shown to schematically represent a fluid passage 54 formed integrally through the front cover (such as front cover 16 of FIG. 1). As shown, the fluid passage 54 has a curved portion 56 directly adjacent on exit port 44. In order to improve laminarity of flow through this curved portion 56, the insert 50 is positioned within the exit port 44 and extends into the curved portion 56 of the passage 54. The plastic insert 50 includes a rim 58 with curved vanes 60,62,64 extending therefrom. As shown, the rim 58 of the insert 50 is trapped between the exit port 44 and the cylinder block 12. The cylinder block 12 includes an inlet 66 to receive the coolant after it exits the exit port 44. The passage 66 in the cylinder block 12 is operatively connected with the coolant passages 22,24 which form the so-called "water jacket" for cooling the cylinders 18,20.

Accordingly, rather than increasing pump capacity to overcome fluid flow loss at sharp bends in fluid passages, the plastic insert of the present invention provides a simple, inexpensive method of improving flow characteristics at such tight corners in a thin front cover design.

The plastic insert 50 is preferably injection molded from a high heat plastic which is resistant to oils or coolant, depending upon the application. Alternatively, the insert could be a cast aluminum component.

While the best mode for carrying out the invention has been described in detail, those familiar with the art to which this invention relates will recognize various alternative designs and embodiments for practicing the invention within the scope of the appended claims.

What is claimed is:

1. An engine assembly for a vehicle, comprising:

an engine crankshaft protruding from a front end of a cylinder block of the engine;

a front cover secured to the front end of the engine;

a pump positioned within the front cover and operatively connected with said engine crankshaft;

a fluid passage formed by said front cover for receiving pumped fluid from said pump and directing the fluid into the cylinder block, said fluid passage having an exit port with a curved portion of the passage positioned closely adjacent the exit port; and a plastic insert positioned within the curved portion and within the exit port, said plastic insert having a plurality of curved fluid flow vanes to direct flowing fluid through the curved portion in a manner to improve laminarity of flow in the curved portion and in the exit port to reduce fluid flow losses.

2. The engine assembly of claim 1, wherein said plastic insert includes a rim which is trapped between the exit port and the cylinder block of the engine.

3. The engine assembly of claim 2, wherein said front cover comprises a cast aluminum body which is bolted to the cylinder block.

4. The engine assembly of claim 1, wherein said plastic insert is injection molded from a plastic material having high heat resistance characteristics.

5. A method of manufacturing a vehicle engine assembly, comprising:

providing a crankshaft protruding from a front end of an engine;

providing a front cover over the front end of the engine, said front cover including a pump therein operatively driven by the crankshaft for pumping fluid through a fluid passage formed within the front cover, said fluid passage having an exit port facing a cylinder block of the engine and having a curved portion of the passage closely adjacent the exit port; and trapping a rim of a plastic insert between the cylinder block and the exit port, said plastic insert having a plurality of curved fluid flow vanes positioned in the curved portion of the fluid passage to direct flowing fluid through the curved portion in a manner to improve laminarity of flow in the curved portion and in the exit port to reduce fluid flow losses.

6. The method of claim 5, wherein said step of providing a front cover comprises casting an aluminum front cover and bolting the front cover to the cylinder block.

7. The method of claim 5, further comprising injection molding the plastic insert with a plastic material having high heat resistance characteristics.

* * * * *